US007047774B1

(12) United States Patent
Gogel

(10) Patent No.: US 7,047,774 B1
(45) Date of Patent: May 23, 2006

(54) SIDE SECURITY DEVICE FOR ROLL-UP DOORS

(76) Inventor: Roy E. Gogel, 218 E. Cranberry La., Greenville, SC (US) 29615

( * ) Notice: Subject to any disclaimer, the term of this patent is extended or adjusted under 35 U.S.C. 154(b) by 0 days.

(21) Appl. No.: 11/087,961

(22) Filed: Mar. 23, 2005

(51) Int. Cl.
*E05B 65/08* (2006.01)

(52) U.S. Cl. ..... 70/32; 70/56; 70/95; 70/100; 70/DIG. 43

(58) Field of Classification Search ..... 70/32–34, 70/54–56, 95, 99, 100, DIG. 43, DIG. 56, 70/2

See application file for complete search history.

(56) References Cited

U.S. PATENT DOCUMENTS 4,345,448 A * 8/1982 Solomon ..... 70/95
4,565,078 A * 1/1986 Solomon ..... 70/95
5,172,574 A * 12/1992 Perfetto ..... 70/56
5,409,271 A * 4/1995 Hoffmann ..... 292/62
5,469,722 A * 11/1995 Ellefsen ..... 70/56
5,806,352 A * 9/1998 Axford ..... 70/56
6,463,769 B1 * 10/2002 Garner ..... 70/56
6,668,601 B1 * 12/2003 Reddick ..... 70/56
6,766,671 B1 * 7/2004 Haczynski et al. ..... 70/34
6,823,701 B1 11/2004 Gogel
6,915,670 B1 * 7/2005 Gogel ..... 70/32

* cited by examiner

*Primary Examiner*—Suzanne Dino Barrett
*Assistant Examiner*—Christopher Boswell
(74) *Attorney, Agent, or Firm*—Charles L. Schwab; Nexsen Pruet, LLC

(57) ABSTRACT

A security device is provided with a housing, which may be installed on a roll-up door of a cargo container, tractor-trailer, or storage facility. The security device includes a removable locking pin structure having a locking pin structure is manually removable through a housing chamber for a puck lock. The housing includes a tab with an opening for receiving the locking rod of a puck shaped lock and the locking pin structure has a window through which the locking rod extends in a locking condition of the lock. Structures are provided for storing the locking pin structure when the security device is unlocked.

7 Claims, 6 Drawing Sheets

SIDE SECURITY DEVICE FOR ROLL-UP DOORS

RELATED APPLICATIONS

A security lock for a roll-up door using a puck lock is shown in my U.S. patent application Ser. No. 10/975,233 filed Oct. 28, 2004 and issued Jul. 12, 2005 as U.S. Pat. No. 6,915,670 for a Security Device for Roll-Up Doors the benefit of which is claimed.

BACKGROUND OF THE INVENTION

This invention is a device for preventing unauthorized opening of the roll-up door of a cargo container of the type used on truck trailers or roll-up doors of garages, warehouses, or mini-storage warehouses. The roll-up door of such installations is customarily secured with rollers that slide or roll within glides that are mounted within the doorframe on laterally opposite sides of the rear of the trailer or the entranceway to the garage or warehouse. The doors typically have hinged horizontal panels that fold as the door is opened by being slid, customarily in an upward direction, along glides that typically turn inward of the trailer or garage at any angle of approximating ninety degrees. Although various locking devices have been proposed for securing roll-up doors, thieves using bolt cutters, power hack saws and sledge hammers are all too frequently destroying the locking devices that are mounted externally on these doors.

SUMMARY OF THE INVENTION

The security device of this invention locks the panel of the roll-up door to one of the laterally opposing doorframes and not the glides, thus preventing the door of the container or garage, warehouse, or mini-storage warehouse, from being opened. This security device may be semi-portable; that is, it could or could not be permanently secured to the door or the doorframe. This invention provides a door security device for use with a lock that protects the lock from unauthorized tampering. These and other objects of the invention are accomplished by providing a securing device to secure a door in its closed position. The securing device includes a rigid housing. It includes an attachment bolt that, when affixed with a hex nut for the semi-portable scenario, secures the securing device to the door. It also includes a locking pin structure with a locking pin and a lock receiving hole for the locking rod of a lock. The rigid housing includes a chamber for receiving the lock, a slot providing limited access to a keyhole of the lock, a lock securing tab and a locking pin ingress/egress opening, as well as a hole for the attachment bolt. In a locking or secured position, the locking pin protrudes from the housing, and the lock is coupled with the lock securing tab to prevent movement of the same. In an unsecured position, the lock is uncoupled from the lock securing tab to permit displacement of the locking pin. The housing provides limited access to the lock once the lock is coupled with the lock securing tab. The securing device is mounted substantially adjacent to a doorframe that includes an aperture for receiving the locking pin.

BRIEF DESCRIPTION OF THE DRAWINGS

Two embodiments of the invention are shown in the accompanying drawings, in which.

DETAILED DESCRIPTION OF THE INVENTION

The present invention is a side securing device particularly suited for securing a roll-up door in its closed position. Additionally, the present invention is a door securing system for securing a door in its closed position using a conventional hockey puck style lock. The securing device is ideally suited for mounting on a roll-up door, such as found on tractor-trailer doors, warehouse dock doors, and mini-storage doors, and to reasonably secure it to its doorframe. Locks that use either mechanical or electronic keys are preferably used with the securing device.

The securing device may be used to secure the door in any desired position depending on the relationship of the door with respect to the corresponding immoveable object, such as a doorframe. Depending on the mounting location of the latching device and the location of a locking pin receive aperture, the door may be secured in a closed position or partially open position. For example, depending on the mounting of the locking device and the location of the locking pin receiving aperture in the doorframe, the garage door may be partially opened and secured in such partially opened position by sliding the locking pin into the receiving aperture and locking the securing device.

Figure 5:
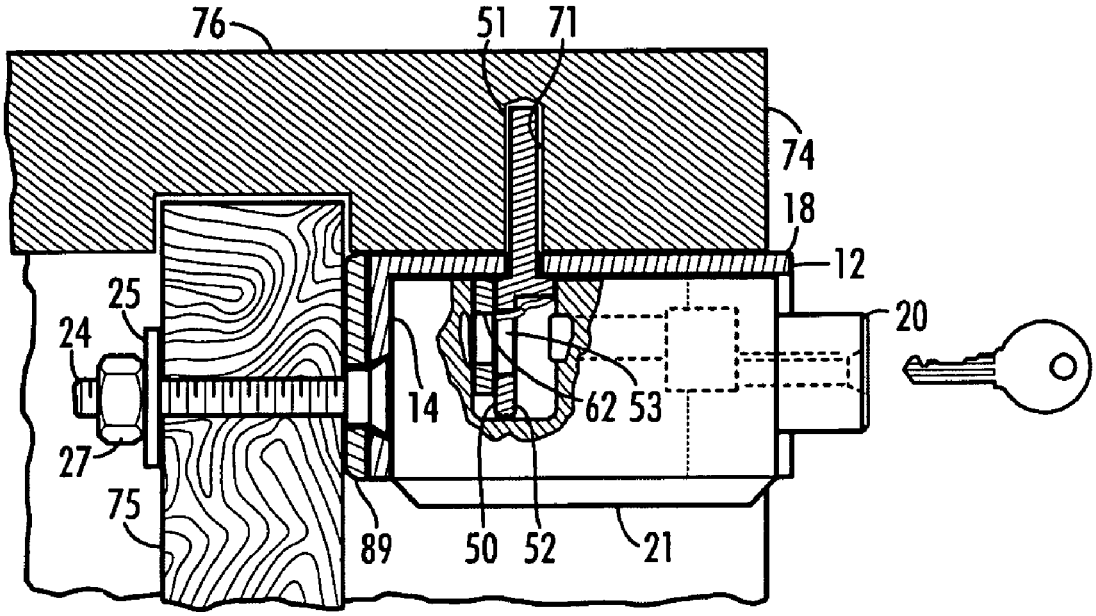
FIG. 5 is a section taken on the line 5—5 in FIG. 4.
Figure 6:
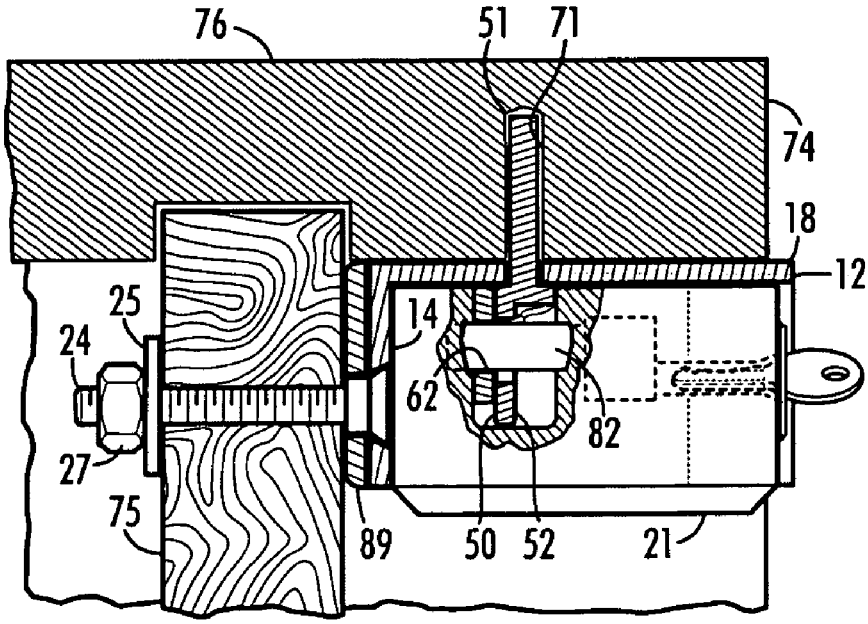
FIG. 6 is a view similar to FIG. 5 showing the lock in a locking condition.
Figure 7:
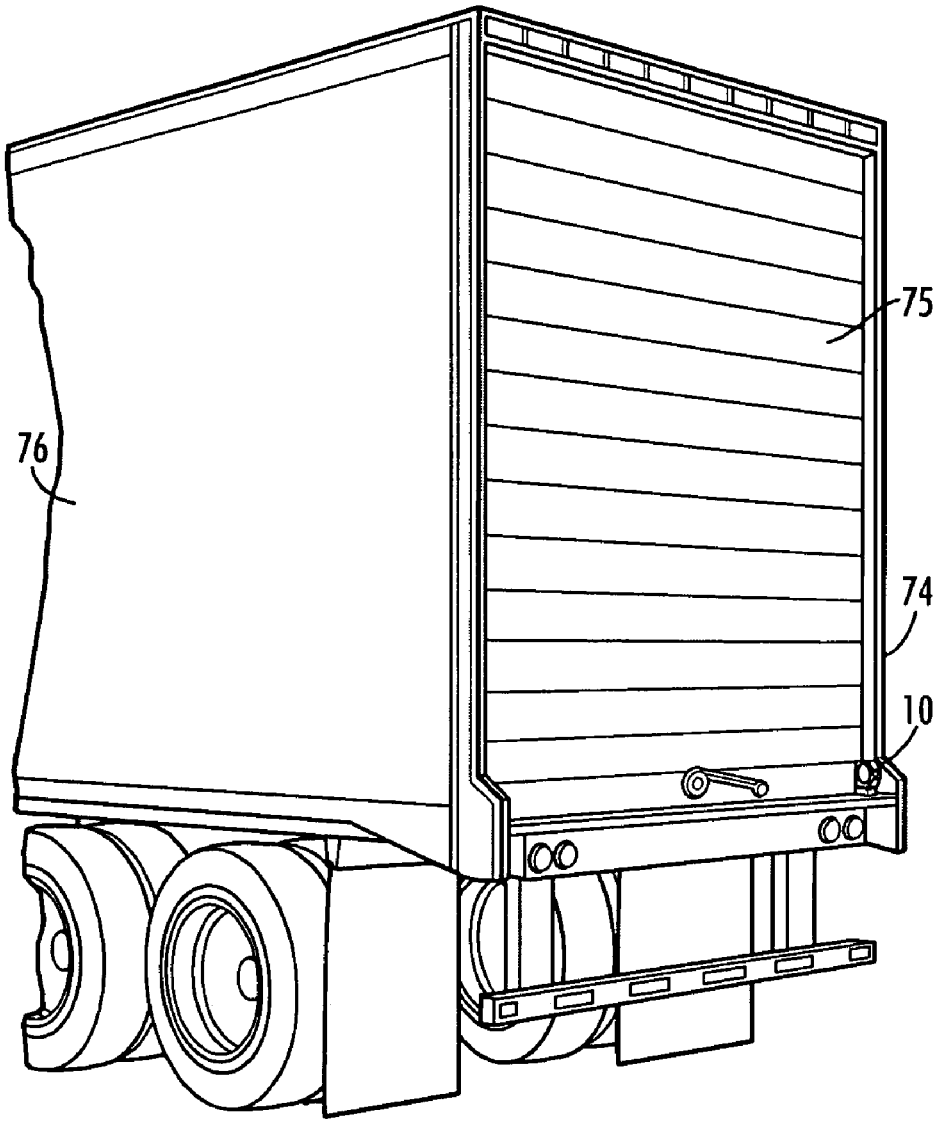
FIG. 7 shows the securing device installed on a truck with a roll up door.

Referring to FIGS. 1 through 6, the security device 10 includes a rigid one piece housing 12 having a flat back wall 18 and a side wall structure which includes a flat rear wall 14, a side wall formed by slanting partial side wall segments 17, 17' and a pair of upper and lower parallel flat side walls 15 and 16 rigidly secured at right angles to the back wall 18 and at right angles to the rear wall 14 to form a chamber 43 with a front opening or slot 19 between the side wall segments 17, 17'. The slot 19 is in the side wall of the housing 12 opposite the rear wall 14. The walls 14, 15, 16 and side wall segments 17, 17' may be welded to one another and to the back wall 18, which has a pin receiving opening 44, or the walls can all be encompassed in one formed part. The slot 19 provides access for a key receiving portion 20 of the shackleless lock 21. The width of the slot 19 is only slightly greater than the diameter of the key receiving portion 20, so as to restrict access to the puck lock 21 when it is installed. In the unlocked condition of the puck lock 21, as shown in FIG. 5, the key receiving portion 20 extends through the slot 19. The locking pin structure 50 includes a locking pin 51 and a rectangular locking rod receiving portion 52 with a window 53 for receiving the rod 82 of the puck lock 21. When the security device 10 is installed as shown in the drawings, the rod receiving portion 52 of the locking pin structure 50 provides lateral reinforcement and stability for the locking pin 51. The rectangular pin receiving portion 52 also serves as a gripping portion aiding manual remove of the pin 51 from the aperture 71 in the doorframe 74. A locking tab 61 welded to the back plate 18 includes an annular opening 62 for receiving the locking rod 82 of the lock 21. When installed, the removable locking pin 51 extends through the locking pin opening 44 of the back wall 18 and into a locking pin receiving aperture 71 in the doorframe 74 of a cargo container 76.

The rear wall 14 of the housing 12 has an annular opening 78 for the tapered head of a bolt 24 and an attachment plate 89 welded to the rear wall 14 has a square opening 79 for receiving the square segment of the mounting bolt 24 positioned between its head and its threaded portion. The bolt 24 extends through a hole 90 drilled in the roll-up door 75 of the cargo container 74 and the bolt 24 is secured by a flat washer 25 and a nut 27. A lock washer, not shown, may also be used. The bolt 24 may be installed or removed from the locking device 10 and the roll-up door 75 when the lock 21 is not in the housing 12. Conventional or specialized adhesives or sealants may be used on the bolt 24 and the hex nut 27 to prevent movement of the same. Alternatively, the housing 12 may be affixed to the roll-up door 75 using a variety of known techniques including, by way of example and not limitation, welding the attachment plate 89 to the roll-up door 75. Thus, when the housing 12 is installed, the flat rear wall 14 of the side wall structure has a flat rigid connection to the door 75.

The attachment plate 89 includes a parking garage or pocket 32 which allows the removable locking pin structure 50 to be stored when the roll-up door 75 is opened. As illustrated, the locking pin structure 50 is tethered to the side wall 15 by a cable 81.

Figure 1:
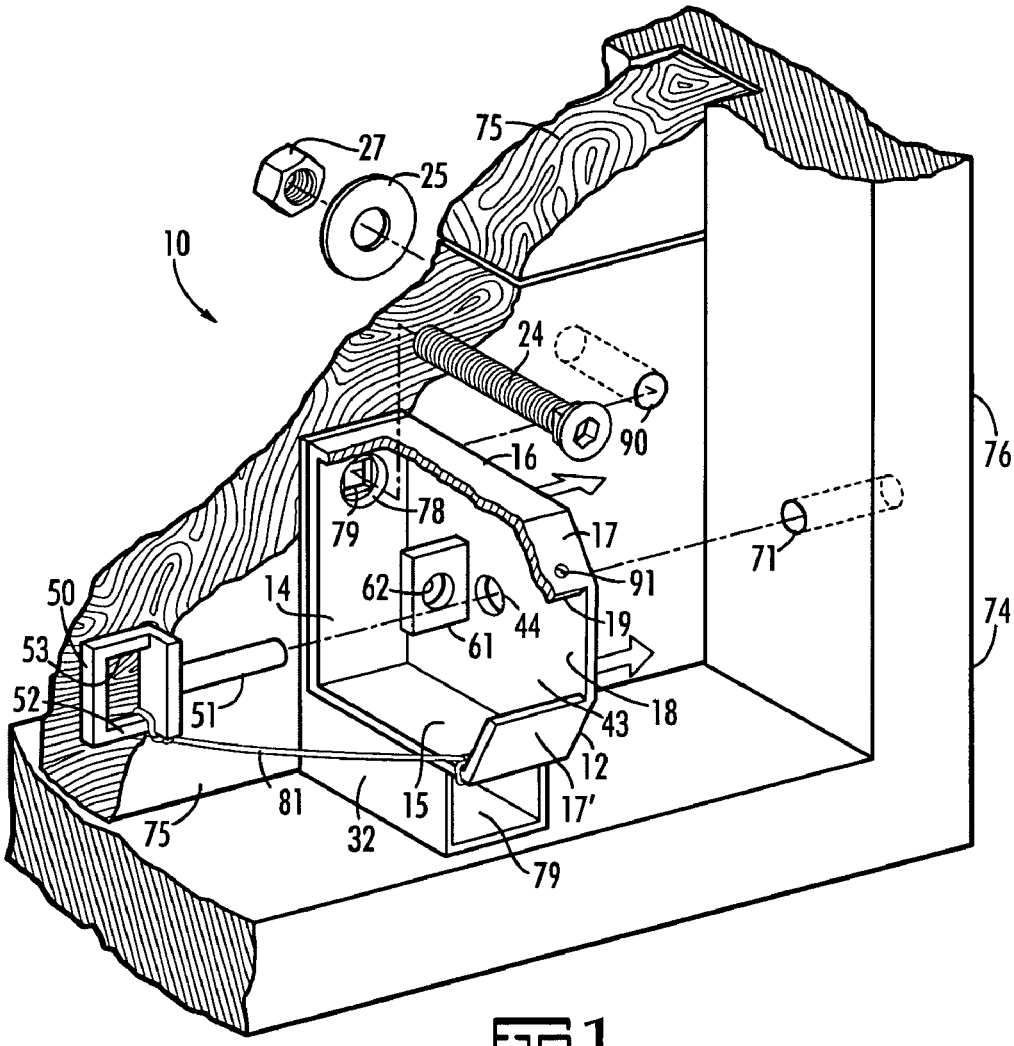
FIG. 1 is an exploded perspective view showing components of one embodiment of the securing device of the present invention.
Figure 2:
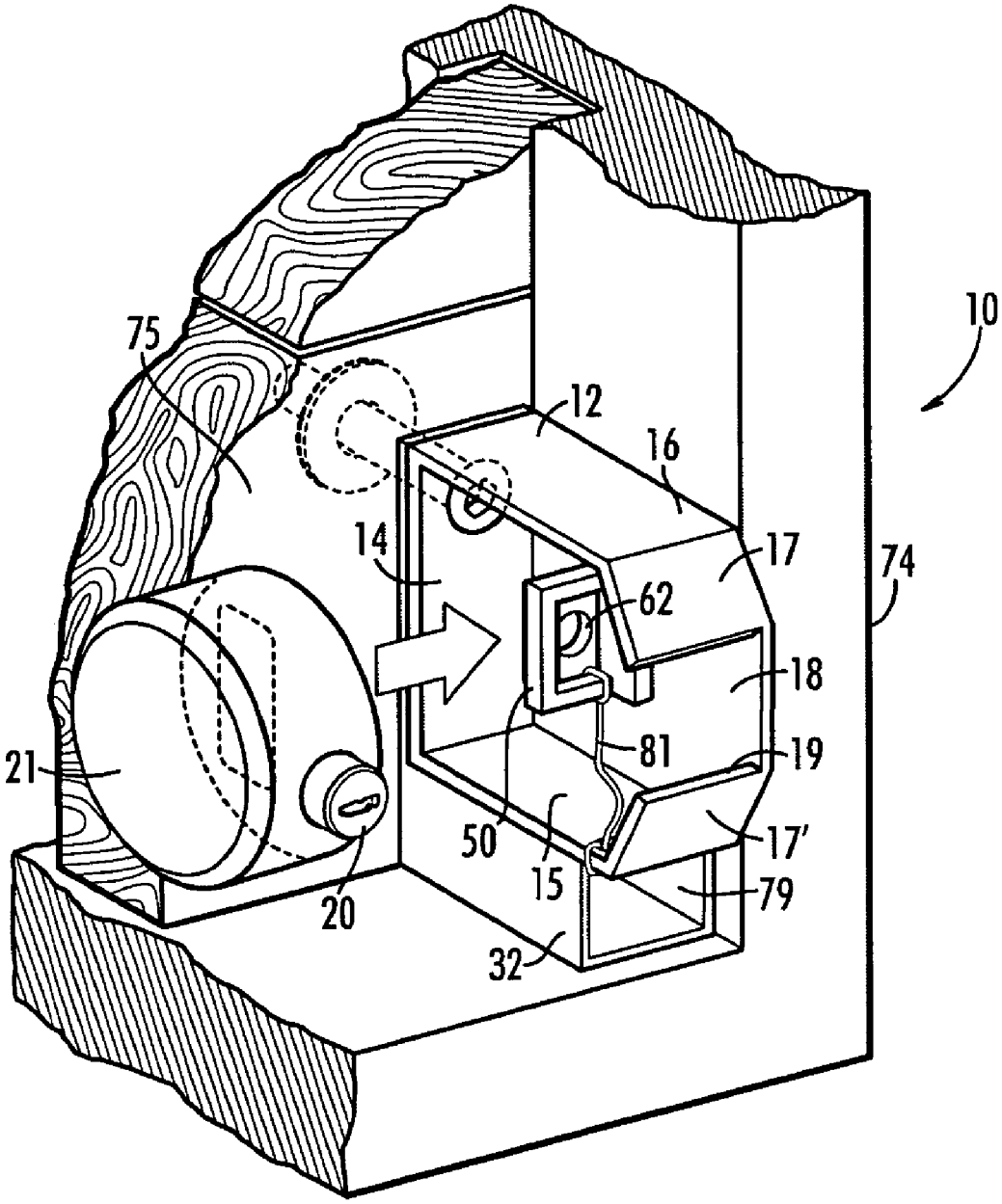
FIG. 2 is a perspective view of the securing device of FIG. 1 with, a lock and showing the fastening components prior to emplacement and securing the lock.
Figure 4:
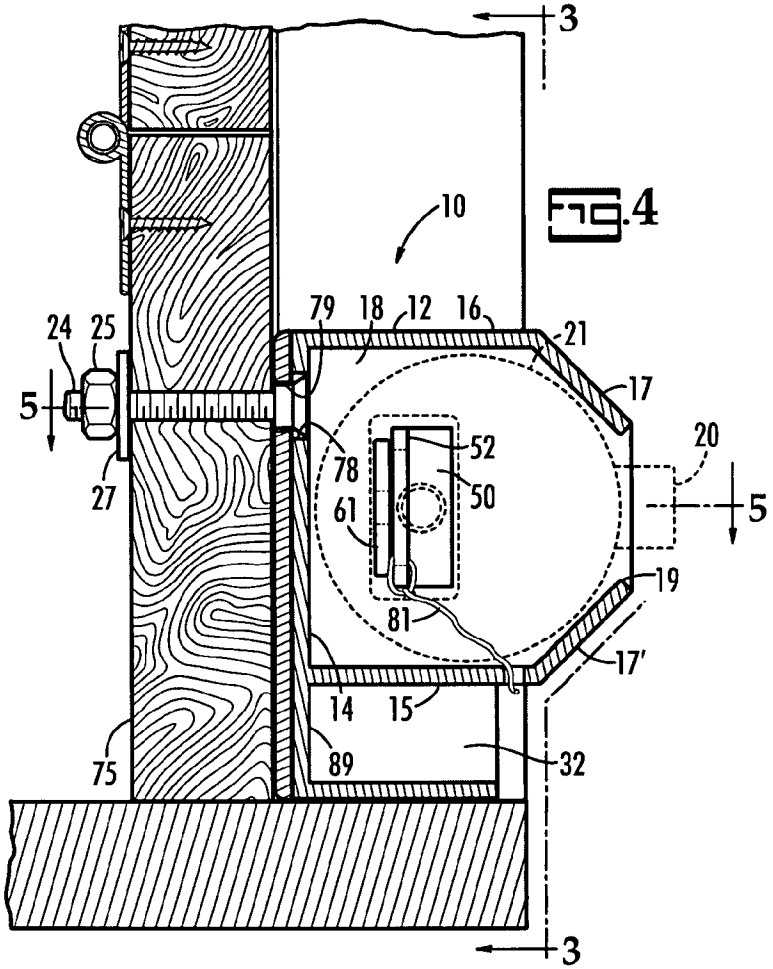
FIG. 4 is a section taken on the line 4—4 in FIG. 3.
Figure 3:
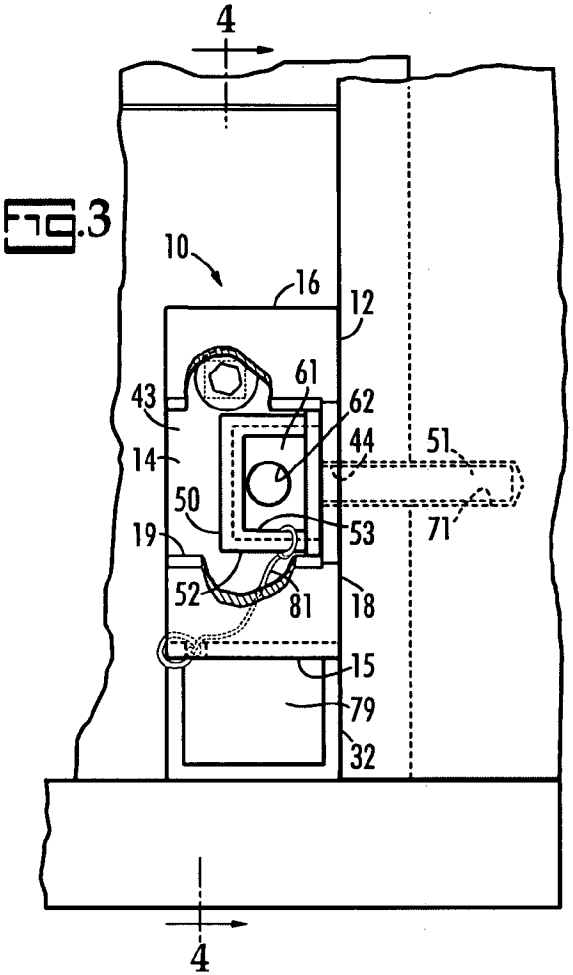
FIG. 3 is an end or front view of the securing device in its locking position.

In a locked position of the lock 21, the locking rod 82 extends through the window 53 of the rectangular bolt receiving portion 52 of the locking pin structure 50 and through the opening 62 in the locking tab 61 thereby locking the locking pin 51 in its installed position. In an unlocked position, after the removable locking pin structure 50 has been removed, the lock 21 can be reinserted in its original position in the chamber 43 and re-secured to minimize loss or misplacement by re-closing the locking rod 82 through the opening 62 of the locking tab 61 and re-locking the lock 21. The lock 21 typically includes a rivet tab, not shown, to which one end of a security chain, not shown, may be attached. The other end of the security chain can be riveted to the housing 12 by using a hole 91 provided in the laterally opposite wall 16, which is shown in FIG. 1.

Figure 8:
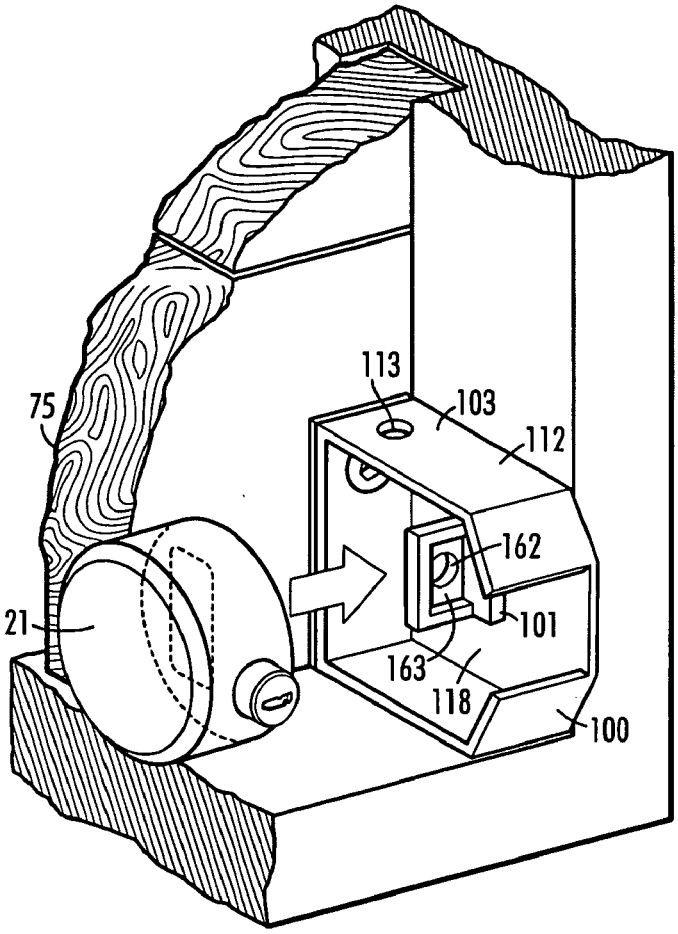
FIG. 8 is a perspective view of a second embodiment of the invention.
Figure 9:
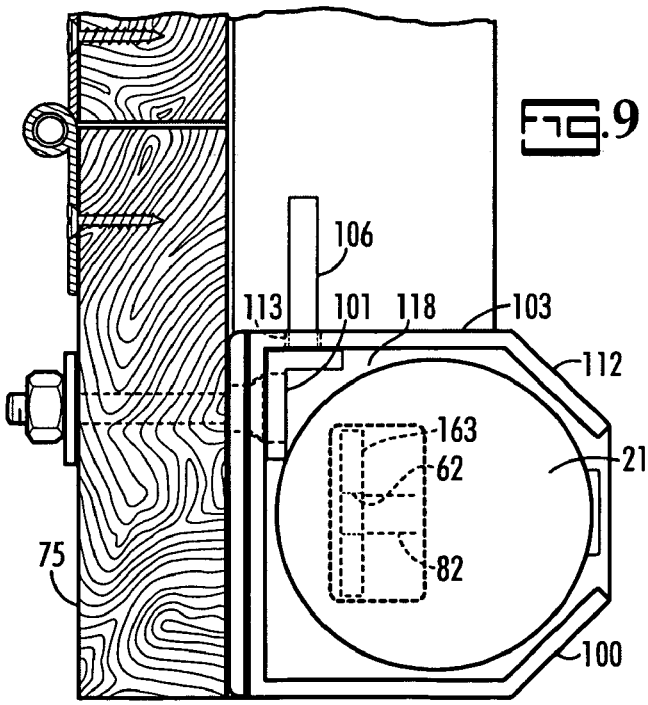
FIG. 9 is a side view of the second embodiment in a non securing condition with the puck lock and the locking pin structure secured to the housing.

A second embodiment of the invention is shown in FIGS. 8 and 9. FIG. 8 shows a security device 100 with its housing 112 bolted to the roll up door 75 and with a locking pin structure 101 installed, thereby locking the roll up door 75. FIG. 8 shows the unlocked puck lock 21 ready for installation in the housing 112. A vertical annular opening 113 is formed in an upper side wall 103 of the housing 112 for storage or parking of the locking pin structure 101 when the roll up door 75 is unlocked. FIG. 9 shows a locking pin 106 of the locking pin structure 101 extending through the opening 113 and the puck lock 21 reinstalled in the housing 112 with its locking rod 82 inserted into an opening 162 of a locking tab 163 welded to a back wall 118, thus locking the puck lock 21 to the housing 112. The presence of the puck lock 21 prevents removal of the locking pin structure 101. In this locked up condition, neither the locking pin structure 101 nor the puck lock 21 can be removed from the housing 112 and they are thus safely stored when the roll up door 75 is unlocked.

The herein disclosed security devices are inexpensive protection against cargo container larceny. They can be installed on existing containers, garages, or storage facilities with ordinary tools in a short period of time. Their relatively narrow configuration avoids interference with door roll-up cables at which may be positioned laterally opposite sides of the roll-up door.

What is claimed is:

1. A security device for locking a door in its closed position to a doorframe having a locking pin receiving aperture by using a puck shaped shackleless lock having a key receiving portion and a locking rod axially shiftable between locked and unlocked positions, said security device comprising:

a rigid housing having a back wall, a side wall structure rigidly secured to said back wall to define a chamber for receiving said puck lock, said side wall structure including;

a rear wall adapted for rigid connection to said door, a pair of upper and lower parallel side walls, and a side wall opposite said rear wall having a slot for receiving said key receiving portion of said puck shaped lock, and an opening in said back wall aligned with said locking pin receiving aperture of said doorframe when said rear wall is connected to said door and said door is in its closed position, a removable locking pin structure including a locking pin and a locking rod receiving portion with a window, said locking pin structure having an installed position in which said locking pin extends through said opening in said back wall and into said locking pin receiving aperture of said doorframe and said window of said rod receiving portion is aligned with said locking rod of said lock received in said chamber, a tab rigidly secured to said back wall and including an opening for receiving said locking rod of said lock when said lock is received is in said chamber and said locking rod is in its locking position, and a vertical opening in said upper side wall for receiving said locking pin to temporarily store said locking pin structure when said door is unlocked.

2. The securing device of claim 1 wherein said lock is connected to said tab to store said lock and to maintain said locking pin structure in its stored condition.

3. The securing device of claim 1 having an opening in said rear wall for receiving a bolt by which said housing is attachable to said door.

4. The securing device of claim 1 wherein said door is a roll-up door.

5. The securing device of claim 1 wherein said rod receiving portion of said locking pin structure serves as a grip for manual removal of said locking pin structure.

6. A security device for locking a door in its closed position to a doorframe having a locking pin receiving aperture by using a puck shaped shackleless lock having a key receiving portion and a locking rod axially shiftable between locked and unlocked positions, said security device comprising:

a rigid housing having a back wall, a side wall structure rigidly secured to said back wall to define a chamber for receiving said puck lock, said side wall structure including;

a rear wall adapted for rigid connection to said door, a pair of upper and lower parallel side walls, and a side wall opposite said rear wall having a slot for receiving said key receiving portion of said puck shaped lock, and an opening in said back wall aligned with said locking pin receiving aperture of said doorframe when said rear wall is connected to said door and said door is in its closed position, a removable locking pin structure including a locking pin and a locking rod receiving portion with a window, said locking pin structure having an installed position in which said locking pin extends through said opening in said back wall and into said locking pin receiving aperture of said doorframe and said window of said rod receiving portion is aligned with said locking rod of said lock received in said chamber, a tab rigidly secured to said back wall and including an opening for receiving said locking rod of said lock when said lock is received is in said chamber and said locking rod is in its locking position, and a locking pin parking tunnel depending downwardly from said housing including an opening for insertion of said removable locking pin structure.

7. A security device for locking a roll-up door in its closed position to a doorframe of a cargo container having a locking pin receiving aperture by using a puck shaped shackleless lock having a key receiving portion and a locking rod axially shiftable between locked and unlocked positions, said security device comprising:

a rigid housing having a flat back wall, a side wall structure rigidly secured to said back wall to define a chamber for receiving said puck lock, said side wall structure including;

a flat rear wall adapted for flat rigid connection to said door, a pair of upper and lower parallel side walls disposed, respectively, at a right angle to said rear wall, and a side wall opposite said rear wall having a slot for receiving said key receiving portion of said puck shaped lock, and an opening in said back wall aligned with said locking pin receiving aperture of said doorframe when said rear wall is connected to said door and said door is in its closed position, a removable locking pin structure including a locking pin and a locking rod receiving portion with a window, said locking pin structure having an installed position in which said locking pin extends through said opening in said back wall and into said locking pin receiving aperture of said doorframe and said window of said rod receiving portion is aligned with said locking rod of said lock received in said chamber, and a tab rigidly secured to said back wall and including an opening for receiving said locking rod of said lock when said lock is received is in said chamber and said locking rod is in its locking position.

* * * * *